US006144279A

United States Patent [19]

Collins et al.

[11] Patent Number: 6,144,279

[45] Date of Patent: Nov. 7, 2000

[54] ELECTRICAL CHOKE FOR POWER FACTOR CORRECTION

[75] Inventors: Aliki Collins, Newton, Mass.; John Silgailis, Cedar Grove, N.J.; Peter Farley, Roselle Park, N.J.; Ryusuke Hasegawa, Morristown, N.J.

[73] Assignee: AlliedSignal Inc., Morristown, N.J.

[21] Appl. No.: 08/819,280

[22] Filed: Mar. 18, 1997

[51] Int. Cl.[7] ..... H01F 17/06; H01F 27/28

[52] U.S. Cl. ..... 336/178; 336/229

[58] Field of Search ..... 336/229, 178, 336/92; 148/31.55

[56] References Cited

U.S. PATENT DOCUMENTS

| | | | |
|---|---|---|---|
| 4,528,481 | 7/1985 | Becker et al. | 315/248 |
| 4,587,507 | 5/1986 | Takayama et al. | 336/178 |
| 4,789,849 | 12/1988 | Ballard et al. | 336/210 |
| 4,969,078 | 11/1990 | Yamamoto et al. | 336/178 |
| 5,315,279 | 5/1994 | Ito et al. | 336/178 |
| 5,481,238 | 1/1996 | Carsten et al. | 336/214 |
| 5,524,334 | 6/1996 | Boesel | 336/96 |
| 5,719,546 | 2/1998 | Ito et al. | 336/180 |
| 5,748,013 | 5/1998 | Beauclair et al. | 336/233 |

*Primary Examiner*—Michael L. Gellner
*Assistant Examiner*—Anh Mai
*Attorney, Agent, or Firm*—Charlotte H. Copperthite; Aaron Nerenberg

[57] ABSTRACT

An electrical choke comprises a magnetic amorphous metal core having, in combination, a distributed gap and a discrete gap. The amorphous metal is an iron based, rapidly solidified alloy. The distributed gap configuration is achieved by subjecting the magnetic core to a heat treatment, causing partial crystallization of the amorphous alloy. Such partial volume crystallization reduces the permeability of the magnetic core from several thousands to a value ranging from 200 to 800. The discrete gap is introduced by cutting the core and inserting a spacer. Depending on the width of the gap and the value of the annealed permeability, effective permeabilities in the range of 200 to 40 can be achieved. Advantageously, the reduced permeability magnetic core maintains its initial permeability under DC bias field excitation and exhibits low core loss, making it especially suited for use in power factor correction applications.

11 Claims, 5 Drawing Sheets

ELECTRICAL CHOKE FOR POWER FACTOR CORRECTION

BACKGROUND OF THE INVENTION

1. Field of the Invention

This invention relates to a magnetic core composed of an amorphous metallic alloy and adapted for electrical choke applications such as power factor correction (PFC) wherein a high DC bias current is applied.

2. Description of the Prior Art

An electrical choke is a DC energy storage inductor. For a toroidal shaped inductor the stored energy is $W=\frac{1}{2}[(B^2A_c l_m)/(2\mu_O\mu_r)]$, where B is the magnetic flux density, $A_c$ the effective magnetic area of the core, $^1$m the mean magnetic path length, and $\mu_O$ the permeability of the free space and $\mu_r$ , the relative permeability in the material.

By introducing a small air gap in the toroid, the magnetic flux in the air gap remains the same as in the ferromagnetic core material. However, since the permeability of the air ($\mu$~1) is significantly lower than in the typical ferromagnetic material ($\mu$~several thousand) the magnetic field strength(H) in the gap becomes much higher than in the rest of the core ($H=B/\mu$). The energy stored per unit volume in the magnetic field is $W=\frac{1}{2}(BH)$, therefore we can assume that it is primarily concentrated in the air gap. In other words, the energy storage capacity of the core is enhanced by the introduction of the gap. The gap can be discrete or distributed.

A distributed gap can be introduced by using ferromagnetic powder held together with nonmagnetic binder or by partially crystallizing an amorphous alloy. In the second case ferromagnetic crystalline phases separate and are surrounded by nonmagnetic matrix. This partial crystallization method is achieved by subjecting an amorphous metallic alloy to a heat treatment. Specifically, there is provided in accordance with that method a unique correlation between the degree of crystallization and the permeability values. In order to achieve permeability in the range of 100 to 400, crystallization is required of the order of 10% to 25% of the volume. The appropriate combination of annealing time and temperature conditions are selected based on the crystallization temperature and or the chemical composition of the amorphous metallic alloy. By increasing the degree of crystallization the permeability of the core is reduced. The reduction in the permeability results in increased ability of the core to sustain DC bias fields and increased core losses.

A discrete gap is introduced by cutting the magnetic core and inserting a nonmagnetic spacer. The size of the gap is determined by the thickness of the spacer. Typically, by increasing the size of the discrete gap, the effective permeability is reduced and the ability of the core to sustain DC bias fields is increased. However, for DC bias excitation fields of 100 Oe and higher, gaps of the order of 5–10 mm are required. These large gaps reduce the permeability to very low levels (10–50) and the core losses increase, due to increased leakage flux in the gap.

For power factor correction applications in power equipment and devices there is a need for a small size electrical choke with low permeability(50–300), low core losses, high saturation magnetization and which can sustain high DC bias magnetic fields.

SUMMARY OF THE INVENTION

The present invention provides an electrical choke having in combination a distributed gap, produced by annealing the core of the choke, and a discrete gap produced by cutting the core. It has been discovered that use in combination of a distributed gap and a discrete gap results in unique property combinations not readily achieved by use of a discrete gap or a distributed gap solely. Surprisingly, magnetic cores having permeability ranging from 80 to 120, with 95% or 85% of the permeability remaining at 50 Oe or 100 Oe DC bias fields, respectively are achieved. The core losses remain in the range of 100 to 150 W/kg at 1000 Oe excitation and 100 kHz.

BRIEF DESCRIPTION OF THE DRAWINGS

The invention will be more fully understood and further advantages will become apparent when reference is made to the following detailed description of the preferred embodiments of the invention and the accompanying drawings in which.

DETAILED DESCRIPTION OF THE INVENTION

The important parameters in the performance of an electric choke are the percent of the initial permeability that remains when the core is excited by a DC field, the value of the initial permeability under no external bias field and the core losses. Typically, by reducing the initial permeability, the ability of the core to sustain increasing DC bias fields and the core losses are increased.

A reduction in the permeability of an amorphous metallic core can be achieved by annealing or by cutting the core and introducing a non magnetic spacer. In both cases increased ability to sustain high DC bias fields is traded for high core losses. The present invention provides an electrical choke having in combination a distributed gap, produced by annealing or by using ferromagnetic powder held together by binder, and a discrete gap produced by cutting the core. The use in combination of the distributed and discrete gaps increases the ability of the core to sustain DC bias fields without a significant increase in the core losses and a large decrease of the initial permeability. These unique properties of the choke are not readily achieved by use of either a discrete or a distributed gap solely.

Figure 1:
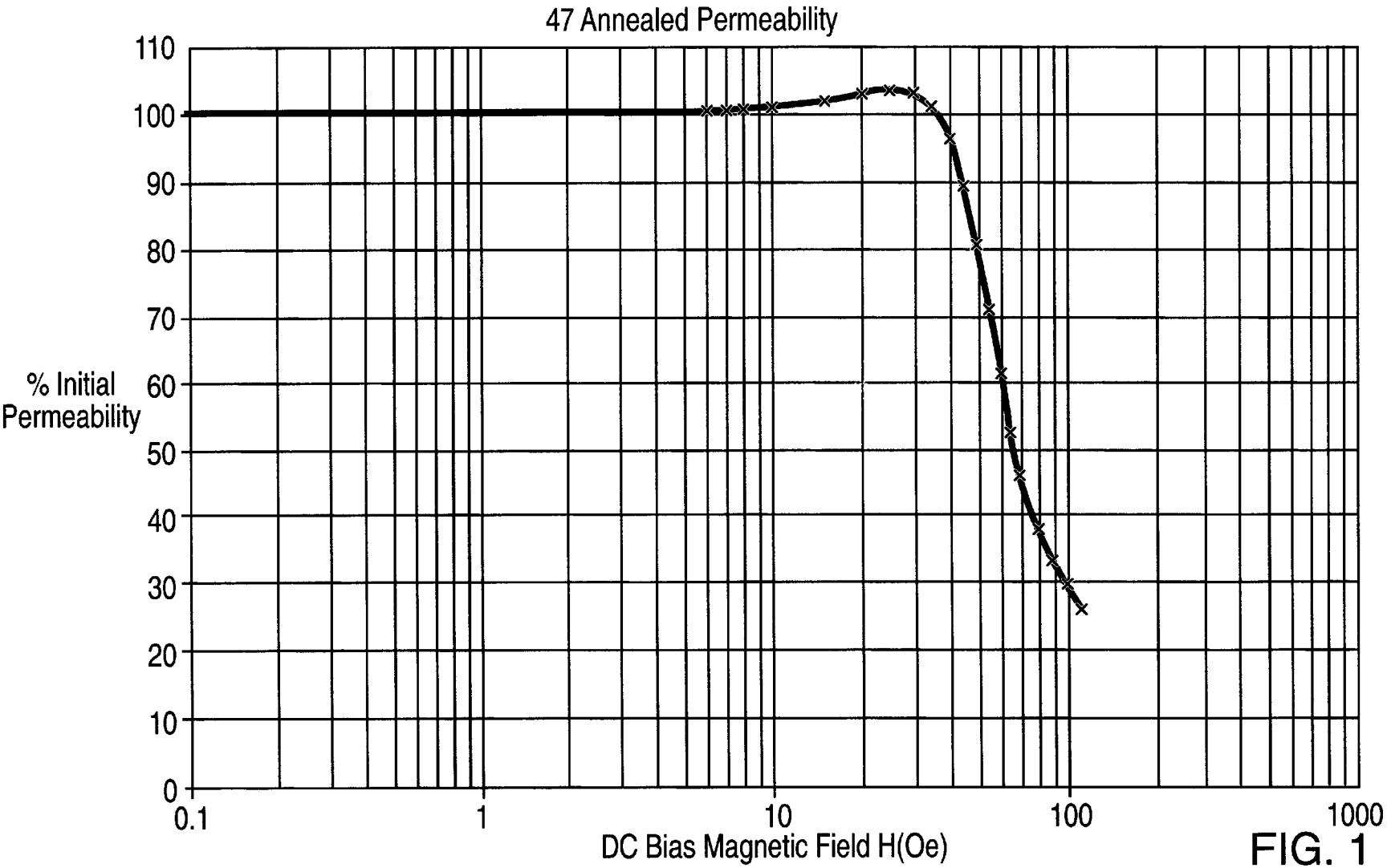
FIG. 1 is a graph showing the percent of the initial permeability of an annealed Fe-based magnetic core as a function of the DC bias excitation field.

In FIG. 1 there is shown as a function of the DC bias excitation field the percent of initial permeability for an annealed Fe base magnetic core. The core, composed of an Fe-B-Si amorphous metallic alloy, was annealed using an appropriate annealing temperature and time combination. Such an annealing temperature and time can be selected for an Fe-B-Si base amorphous alloy, provided its crystallization temperature and or chemical composition are known. For the core shown in FIG. 1, the composition of the amorphous metallic alloy was $Fe_{80}B_{11}Si_9$ and the crystallization temperature was Tx=507° C. This crystallization temperature was measured by Differential Scanning Calorimetry (DSC). The annealing temperature and time were 480° C. and 1 hr, respectively and the annealing was performed in an inert gas atmosphere. The amorphous alloy was crystallized to a 50% level, as determined by X-ray diffraction. Due to the partial crystallization of the core, its permeability was reduced to 47. By choosing appropriate temperature and time combinations, permeability values in the range of 40 to 300 and higher are readily achieved. Table 1 summarizes the annealing temperature and time combinations and the resulting permeability values. The permeability was measured with an induction bridge at 10 klz frequency, 8-turn jig and 100 mVac excitation.

TABLE 1

| Annealing Conditions | Permeability @ 10 KHZ | DC Bias 10 KHz 50 Oe | 80 Oe | Core loss (W/Kg) @ 100 kHz, 0.035 T |
|---|---|---|---|---|
| 450 C./4 hrs | 191 | 14 | 8 | |
| 450 C./4 hrs | 213 | 11 | 7 | |
| 450 C./7 hrs | 121 | 20 | 12 | |
| 450 C./8 hrs | 212 | 13 | 7 | |
| 450 C./8 hrs | 218 | 11 | 7 | |
| 450 C./10 hrs | 207 | 12 | 7 | 19 |
| 450 C./10 hrs | 212 | 15 | 8 | 12 |
| 450 C./6 hrs | 203 | 18 | 10 | 14 |
| 460 C./4 hrs | 124 | 24 | 15 | |
| 460 C./4 hrs | 48 | 74 | 41 | |
| 470 C./15 min | 500 | 6 | 1 | 2.5 |
| 470 C./30 min | 145 | 17 | 8 | 13 |
| 470 C./1 hr | 189 | 15 | 6 | 10 |
| 470 C./1 hr | 132 | 23 | 11 | 14 |
| 470 C./2 hrs | 45 | 78 | 41 | |
| 470 C./2 hrs | 47 | 76 | 40 | 53 |
| 470 C./3.5 hrs | 45 | 75 | 37 | |
| 480 C./15 min | 43 | 75 | 35 | 65 |
| 480 C./15 min | 44 | 40 | 32 | 56 |
| 480 C./1 hrs | 46 | 77 | 37 | |
| 480 C./1 hrs | 47 | 81 | 38 | 47 |
| 490 C./15 min | 46 | 76 | 37 | |
| 490 C./15 min | 46 | 80 | 38 | |
| 490 C./30 min | 46 | 82 | 39 | |
| 490 C./30 min | 46 | 78 | 36 | |

AlloyFe80B11Si9 Tx = 508 C.

As illustrated by FIG. 1, 80% of the initial permeability was maintained at 50 Oe while 30% of the initial permeability was maintained at 100 Oe. The core loss was determined to be 650 W/kg at 1000 Oe excitation and 100 kHz.

Figure 2:
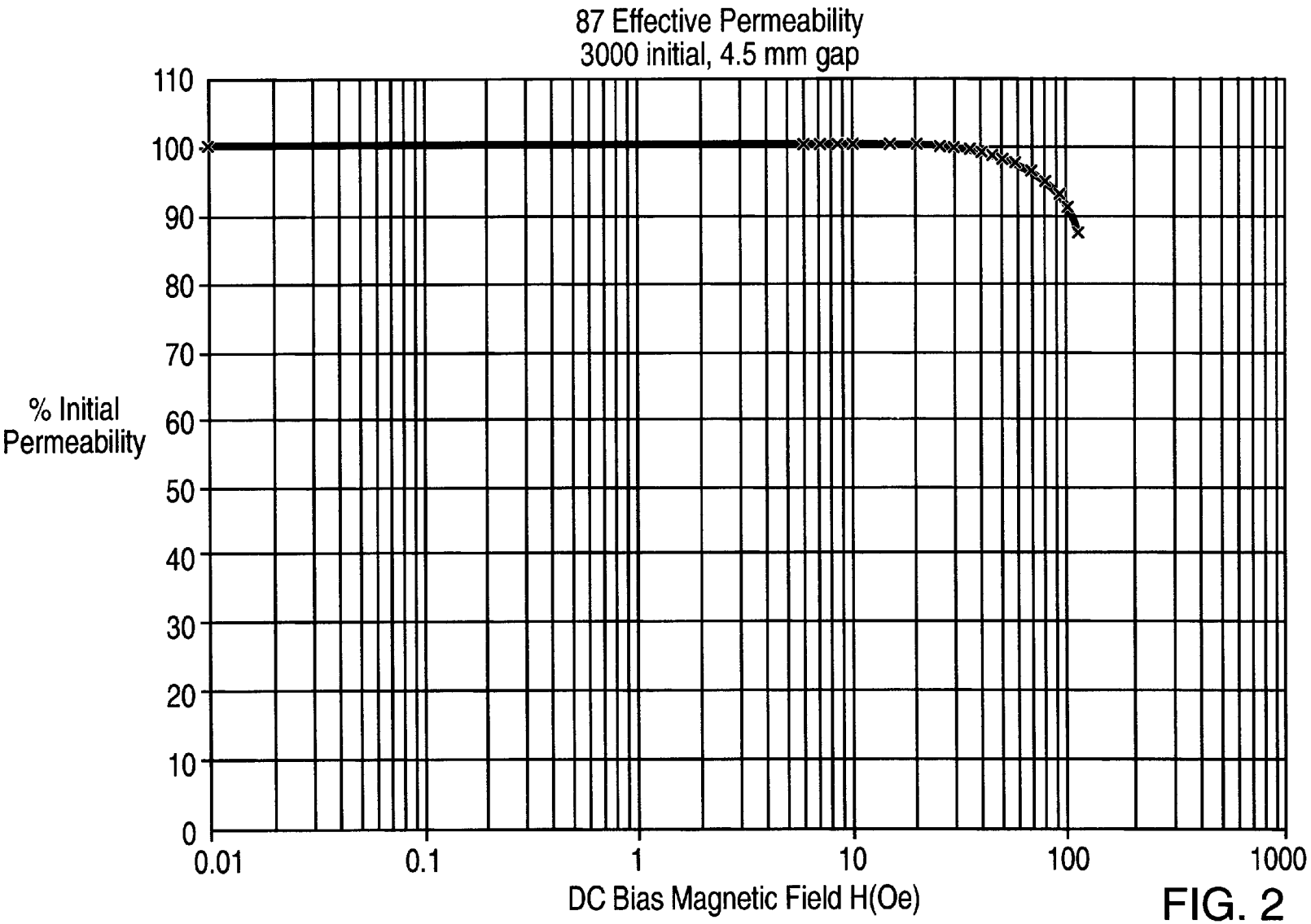
FIG. 2 is a graph showing, as a function of the DC bias excitation field, the percent of the initial permeability of an Fe-based amorphous metallic alloy core, the core having been cut, and having had inserted therein a discrete spacer having a thickness of 4.5 mm.

FIG. 2 depicts, as a function of the DC bias excitation field, the percent of the initial permeability of an Fe base amorphous core, the core having been cut with an abrasive saw and having had inserted therein a discrete plastic spacer having a thickness of 4.5 mm. The initial permeability of the Fe base core was 3000 and the effective permeability of the gapped core was 87. The core retained 90% of the initial permeability at 100 Oe. However, the core losses were 250 W/kg at 1000 Oe excitation and 100 kHz.

Figure 3:
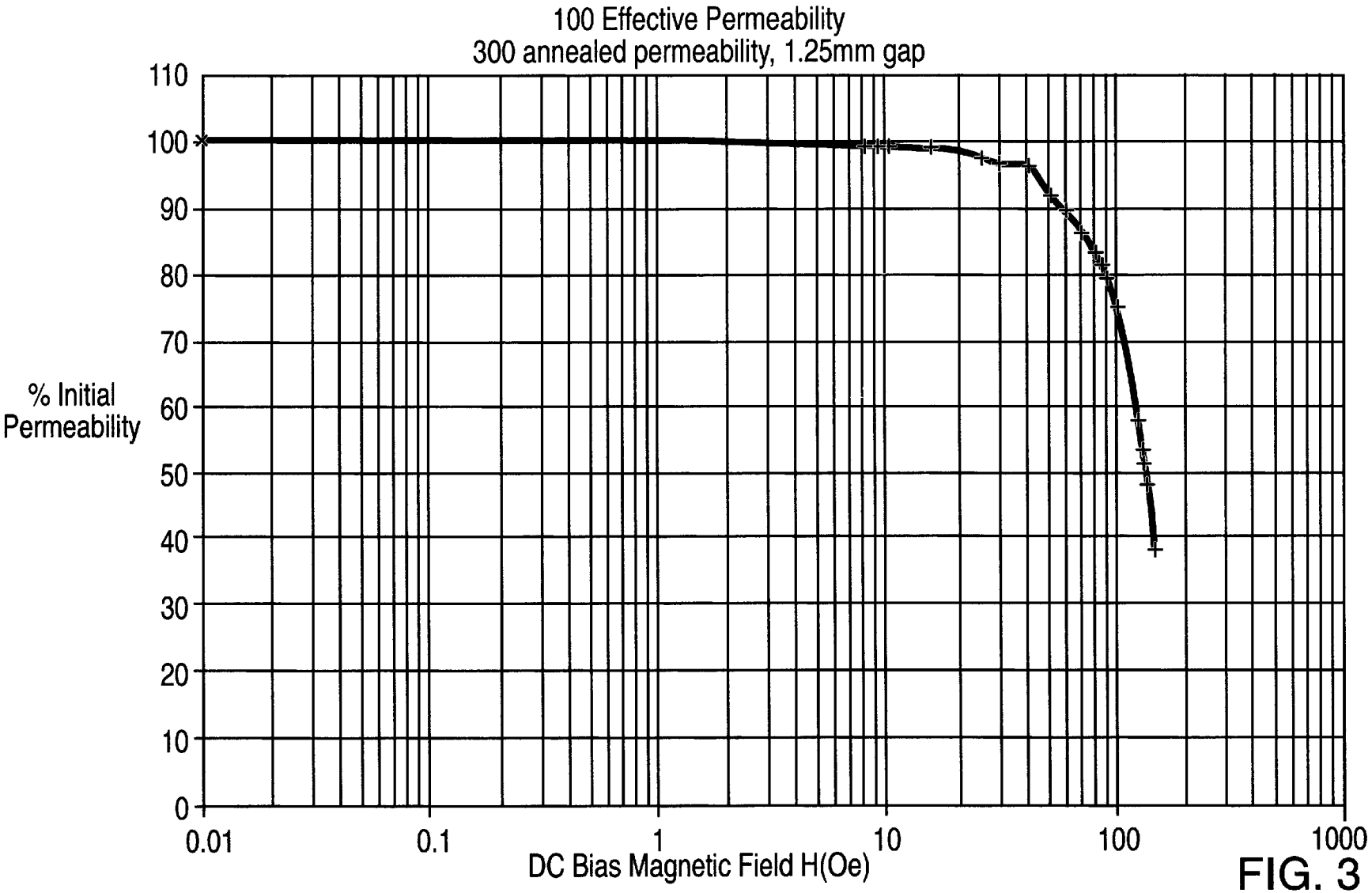
FIG. 3 is a graph showing, as a function of the DC bias excitation field, the percent of initial permeability of an Fe-base core having a discrete gap of 1.25 mm and a distributed gap.

FIG. 3 depicts, as a function of the DC bias excitation field, the percent of initial permeability of an Fe base core having, in combination, a discrete gap of 1.25 mm and a distributed gap. The amorphous Fe base alloy can be partially crystallized using an appropriate annealing temperature and time combination, provided its crystallization temperature and or chemical composition are known. The example shown in FIG. 3 had a composition consisting essentially of $Fe_{80}B_{11}Si_9$ and a crystallization temperature Tx=507° C. The annealing temperature and time were 430° C. and 6.5 hr, respectively and the annealing was performed in an inert gas atmosphere. This annealing treatment reduced the permeability to 300. Subsequently, the core was impregnated with an epoxy and acetone solution, cut with an abrasive saw to produce a discrete gap and provided with a plastic spacer of 1.25 mm, which was inserted into the gap. Impregnation of the core is required to maintain the mechanical stability and integrity thereof core during and after the cutting. The final effective permeability of the core was reduced to 100. At least 70% of the initial permeability was maintained under 100 Oe DC bias field excitation. The core loss was 100 W/kg at 1000 Oe excitation and 100 kHz.

FIGS. 1, 2 and 3 illustrate that in order to improve the DC bias behavior of an Fe base amorphous core while, at the same time, keeping the initial permeability high and the core losses low, a combination of a discrete and distributed gaps is preferred.

Figure 4:
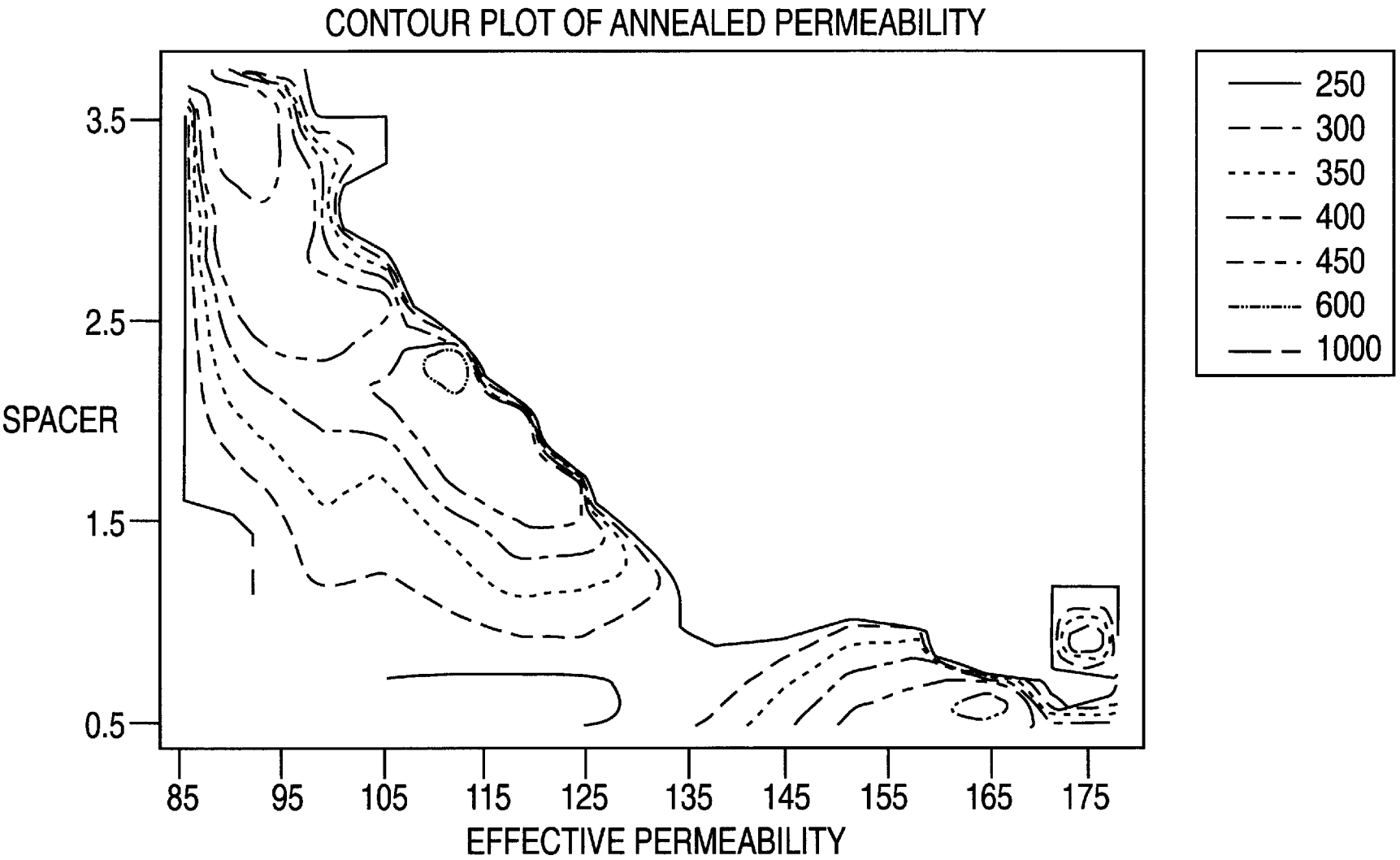
FIG. 4 is a graph showing, as a function of discrete gap size, empirically derived contour plots of the effective permeability for the combined discrete and distributed gaps, the different contours representing permeability values for the distributed gap.

The conventional formula for calculating the effective permeability of a gapped choke is not applicable for a core having in combination a discrete and a distributed gap. FIG. 4 depicts, as a function of the discrete gap size, empirically derived contour plots of the effective permeability for a core having combined discrete and distributed gaps. The different contours represent the various values of the distributed gap (annealed) permeability. Table 2 displays various combinations of annealed permeability and discrete gap sizes. The corresponding effective permeability, percent permeability at 100 Oe and core losses are listed, as well as the cutting method and the type of the spacer material.

TABLE 2

| Annealed Perm | Spacer (mm) | Effective Perm | % Perm @ 50 Oe | % Perm @ 100 Oe | Core loss(W/kg) | Cutting Method | Spacer Type |
|---|---|---|---|---|---|---|---|
| 300 | 1.25 | 107.2 | 93.4 | 74.4 | 87 | abrasive saw | plastic |
| 300 | 1.25 | 103.4 | 91.6 | 74.6 | 91 | abrasive saw | plastic |
| 300 | 1.25 | 101.5 | 93.1 | 74.6 | 86 | abrasive saw | plastic |
| 300 | 1.25 | 97.3 | 93.6 | 77.6 | 100 | asrasive saw | plastic |
| 300 | 1.25 | 97 | 94 | 78 | 34* | abrasive saw | plastic |
| 300 | 1.5 | 96 | 94 | 79 | 34* | abrasive saw | plastic |
| 300 | 2 | 87 | 94 | 82 | 40* | abrasive saw | plastic |
| 300 | 2.5 | 81 | 94 | 84 | 45* | abrasive saw | plastic |
| 300 | 3 | 75 | 95 | 86 | 51* | abrasive saw | plastic |
| 300 | 4.5 | 65 | 97 | 91 | 63* | abrasive saw | plastic |

TABLE 2-continued

| Annealed Perm | Spacer (mm) | Effective Perm | % Perm @ 50 Oe | % Perm @ 100 Oe | Core loss(W/kg) | Cutting Method | Spacer Type |
|---|---|---|---|---|---|---|---|
| 300 | 8.25 | 53 | 98 | 93 | 68* | abrasive saw | plastic |
| 300 | 12.75 | 43 | 99 | 96 | 79* | abrasive saw | plastic |
| 300 | 1.25 | 105.2 | 92 | 72.4 | 86 | abrasive saw | plastic |
| 1000 | 3.75 | 88.3 | 97.1 | 88.3 | 115 | abrasive saw | plastic |
| 1000 | 3.75 | 85.3 | 97.2 | 89.4 | 109 | abrasive saw | plastic |
| 250 | 0.5 | 129.3 | 82.3 | 50.4 | 105 | abrasive saw | plastic |
| 250 | 0.75 | 111.8 | 84.4 | 58.7 | 170 | abrasive saw | plastic |
| 250 | 1.5 | 91.8 | 92.5 | 73.4 | 212 | abrasive saw | plastic |
| 450 | 0.5 | 177.5 | 89.9 | 18.3 | 108 | abrasive saw | plastic |
| 450 | 0.75 | 158.9 | 91.9 | 33.3 | 101 | abrasive saw | plastic |
| 450 | 1.5 | 118.8 | 95.9 | 77 | 110 | abrasive saw | plastic |
| 450 | 2.25 | 100 | 95.7 | 86.4 | 96 | abrasive saw | plastic |
| 350 | 1.5 | 104 | 95 | 78 | 110 | abrasive saw | plastic |
| 350 | 1.5 | 105 | 94 | 77 | 117 | abrasive saw | plastic |
| 350 | 1.5 | 103 | 95 | 79 | 114 | abrasive saw | plastic |
| 350 | 1.5 | 104 | 95 | 79 | 115 | abrasive saw | plastic |
| 350 | 1.5 | 99 | 95 | 79 | 112 | abrasive saw | plastic |
| 450 | 2.25 | 94 | 97 | 87 | 98 | abrasive saw | plastic |
| 450 | 2.25 | 95 | 95 | 81 | 111 | abrasive saw | plastic |
| 450 | 2.25 | 94 | 96 | 83 | 105 | abrasive saw | plastic |
| 450 | 2.25 | 96 | 95 | 82 | 120 | abrasive saw | plastic |
| 580 | 3 | 89 | 97 | 85 | 106 | abrasive saw | pLastic |
| 580 | 3 | 89 | 97 | 90 | 103 | abrasive saw | plastic |
| 580 | 3 | 92 | 98 | 90 | 110 | abrasive saw | plastic |
| 580 | 3 | 89 | 97 | 88 | 104 | abrasive saw | plastic |
| 250 | 0.75 | 110 | 85 | 58 | 89 | wire edm | plastic |
| 250 | 0.75 | 91 | 93 | 74 | 101** | water jet | plastic |
| 250 | 0.75 | 118 | 82 | 57 | 89*** | abrasive saw | ceramic |
| 250 | 0.75 | 124 | 82 | 54 | 99*** | abrasive saw | plastic |
| 250 | 0.75 | 117 | 84 | 57 | 89*** | abrasive saw | plastic |
| 250 | 0.75 | 115 | 85 | 58 | 90*** | abrasive saw | plastic |

Core loss was measured at 1000 Oe excitation field and 100 kHz with the exception of
*Excitation field 500 Oe
**Excitation field 850 Oe
*Excitation field 900 Oe Two different types of spacer material, plastic and ceramic, were evaluated. No difference was observed in the resulting properties. Typically the magnetic core is placed in a plastic box 70 (see FIG. 6**). Since a plastic spacer can be used for the gap, the spacer can be molded directly into the plastic box.

Several methods for cutting the cores were evaluated, including an abrasive saw, wire electro-discharge machining (wire edm), and water jet. All these methods were successful. However, there were differences in the quality of the cut surface finish, with the wire edm being the best and the water jet the worst. From the results in Table 2, it was concluded that the wire edm method produced cores exhibiting the lowest losses and the water jet method the highest, with all other conditions being equal. The abrasive method produced cores with satisfactory surface finish and core losses. From the above results it was concluded, that the finish of the cut surface of the core is important for achieving low core losses.

Figure 5:
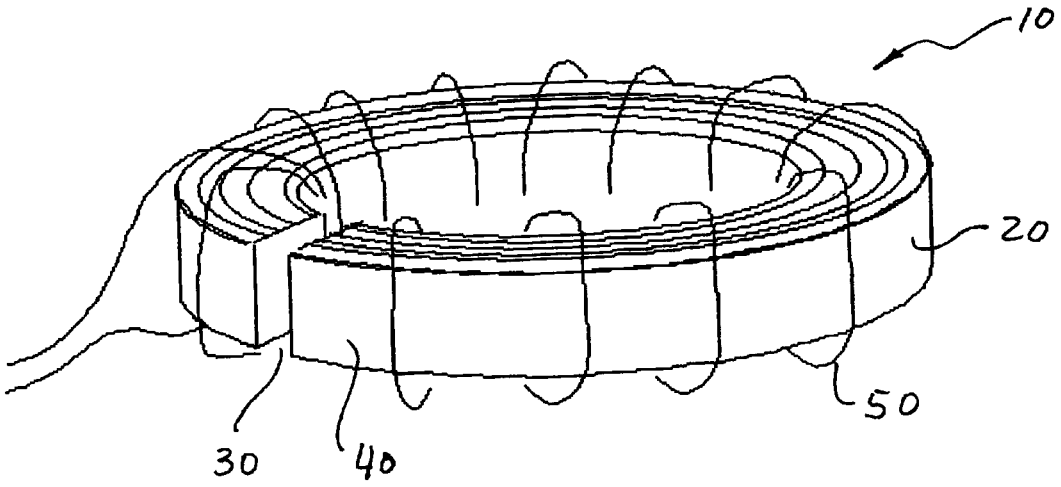
FIG. 5 is a perspective view of an electrical choke having a discrete gap and is distributed gap and constructed in accordance with the present invention.
Figure 6:
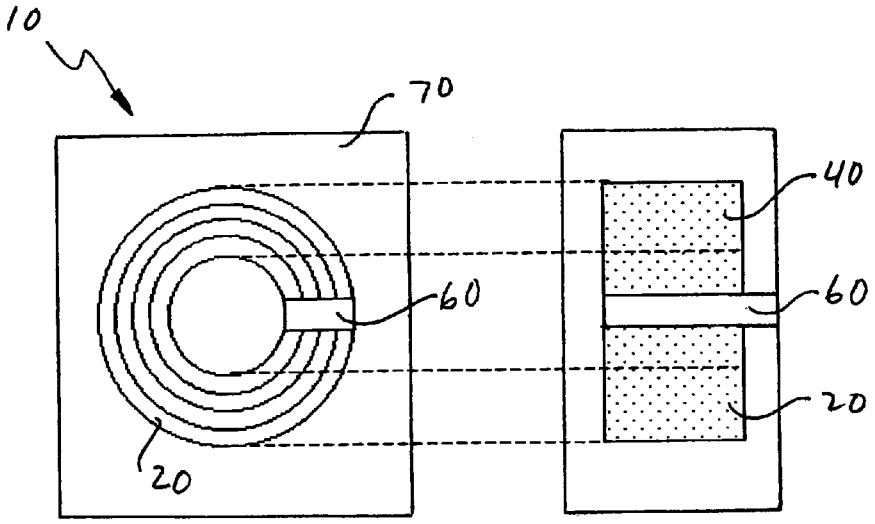
FIG. 6 is a top and side view of an electrical choke having a distributed gap and a discrete gap having non-magnetic spacer disposed therein and constructed in accordance with the present invention.

Referring next to FIG. 5, the electrical choke 10 of the present invention comprises a ferromagnetic metal alloy core 20 having a discrete gap 30 and a distributed gap 40. The core 20 may be partially crystallized amorphous metal or, alternatively, it may be a ferromagnetic powder held together by a binder. The discrete gap 30 comprises an opening cut in the core 20, and may include a non-magnetic spacer 60, as shown in FIG. 6. When a spacer 60 is provided, the size of the discrete gap 30 is approximately equal to the size of the spacer 60. The distributed gap 40 is produced by annealing or by using ferromagnetic powder held together by a binder to partially crystallize the core 20. The core 20 is preferably crystallized to approximately 50% the crystallization level of the remainder of the core 20. A coil 50 is disposed about the discrete gap 30 and distributed gap 40.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. An electrical choke comprising a coil and a ferromagnetic metal alloy core having a distributed gap and a discrete gap, wherein said core is a partially crystallized amorphous metal alloy having an annealed permeability in the range of 100 to 800, and further comprising a non-magnetic spacer located in an opening defined by said discrete gap, said gap having a gap size determined by the thickness of said spacer.

2. An electrical choke as recited by claim 1, having an annealed permeability ranging from about 200 to 1000, a gap size ranging in width from about 0.75 mm to 12.75 mm and an effective permeability ranging from about 40 to 200.

3. An electrical choke as recited by claim 2, having an effective permeability ranging from 40 to 200, a core loss, ranging from 80 to 200 W/kg at 100 kHz and 1000 Oe excitation field and DC bias ranging from 50% to 95% at 100 Oe DC bias field.

4. An electrical choke as recited by claim 3, wherein the width of said discrete gap ranges from 0.75 mm to 12.75 mm and wherein said core has an effective permeability ranging between 40 and 200.

5. An electrical choke as recited by claim 3, in which the effective permeability of the core is 100 and wherein said electrical choke further comprises a non-magnetic spacer located in an opening defined by said discrete gap and having a thickness of 1.25 mm.

6. An electrical choke as recited by claim 5, in which said core retains at least 75% of said effective permeability under DC bias excitation of 100 Oe.

7. An electrical choke as recited by claim 5, in which said core has a core loss ranging from 80 to 100 W/kg at 1000 Oe excitation and 100 kHz.

8. An electrical choke as recited by claim 1, in which said non magnetic spacer is composed of ceramic or plastic and molded directly into a plastic box containing said core.

9. An electrical choke as recited by claim 1, said core being coated with a thin high temperature resin for electrical insulation and maintenance of core integrity.

10. An electrical choke as recited by claim 1, wherein said core is a ferromagnetic powder held together by a binder.

11. An electrical choke for Power Factor Correction comprising a coil and a ferromagnetic metal alloy core having a distributed gap and a discrete gap, wherein said core is a partially crystallized amorphous metal alloy having an annealed permeability in the range of 100 to 800, and further comprising a non-magnetic spacer located in an opening defined by said discrete gap, said gap having a gap size determined by the thickness of said spacer.

* * * * *